United States Patent [19]

Crooimans

[11] Patent Number: 4,850,143

[45] Date of Patent: Jul. 25, 1989

[54] INTER-PANEL HERMETIC SEAL

[75] Inventor: Peter Crooimans, Boulder, Colo.

[73] Assignee: Anna Elizabeth Crooimans, Loveland, Colo. ; a part interest

[21] Appl. No.: 176,382

[22] Filed: Mar. 31, 1988

[51] Int. Cl.[4] ..... E05D 11/00

[52] U.S. Cl. ..... 49/383

[58] Field of Search ..... 49/383, 499; 160/229.1, 160/231.2

[56] References Cited

U.S. PATENT DOCUMENTS

| | | | |
|---|---|---|---|
| 1,444,398 | 2/1923 | Shepherd . | |
| 2,694,234 | 11/1954 | Roby et al. | 20/16 |
| 2,860,384 | 11/1958 | Wait et al. | 49/383 X |
| 3,302,690 | 2/1967 | Hurd | 49/383 X |
| 4,040,142 | 8/1977 | Ippolito | 16/137 |
| 4,261,140 | 4/1981 | McLean | 49/383 |

FOREIGN PATENT DOCUMENTS

| | | | |
|---|---|---|---|
| 528421 | 5/1954 | Belgium | 49/383 |
| 133401 | 8/1929 | Switzerland . | |
| 2019475 | 10/1979 | United Kingdom | 49/383 |

*Primary Examiner*—Philip C. Kannan

*Attorney, Agent, or Firm*—Kyle W. Rost

[57] ABSTRACT

A seal for closing the gap between adjacent panels is formed from plastic sheet material having lateral attachment areas bearing adhesive bands on the opposite edges of one face. The seal area between the attachment areas constitutes a barrier web and folds between the attachment areas, defining a triple air column insulator.

11 Claims, 1 Drawing Sheet

INTER-PANEL HERMETIC SEAL

BACKGROUND OF THE INVENTION

1. Field of the Invention

The invention generally relates to movable or removable closures and more specifically to a closure seal, such as a striker gasket or weatherstrip that interengages sections on closures or on closure and portal frame, or that encloses or is carried by a closure edge surface, or wherein a U-shaped member or portion mounts the seal. Specifically, the invention relates to a hermetic seal for the hinge-edge side of a door.

2. Description of the Prior Art

The exterior door in commercial construction carries a weather seal in order to prevent or limit the infiltration of outside air. This seal may take any of several popular forms. Often, the floor edge of a door will carry a labyrinth seal that engages the doorsill. In addition, the floor edge may carry a felt tongue or lip that brushes the floor to better seal the threshold. All remaining edges of the door employ seals that are active only when the door is closed. These edge seals may be formed of spring metal, plastic ribs, foam or felt strips, brushes, or other devices that compress against the door frame or jamb when the door is closed.

While these seals may be effective when properly in place, it is seldom evident whether they continue to work properly. Since these seals' operation is limited to times when a door is closed, one must inspect the door quite closely to determine whether the fit is proper and whether the seals have remained intact. Indeed, many doors become slightly warped and thereafter fail to fully close against a previously installed seal. Also, over time many types of seal lose their integrity due to physical damage, shrinkage, or loss of flexibility. Because the failure of door seals may not be readily evident, these problems can lead to long term air infiltration and unnecessary heating and cooling costs. Thus, it would be desirable to have weather seals that can be known to be in good operation by even casual inspection. Further, it remains desirable to improve the efficiency of weather seals. Also, it would be beneficial to have weather seals that operate over an extended range of door positions, including when a door is partially or fully open.

Various patent art shows guards that are applied at the hinge-edge of a door. For example, U.S. Pat. No. 4,040,142 to Ippolito relates to a bellows that covers the hinge opening of a door for safety purposes.

U.S. Pat. No. 2,694,234 to Roby et al discloses a finger guard that covers the hinge edge of a swinging door to prevent pinching a finger in the hinge crack.

U.S. Pat. No. 1,444,398 to Shepherd discloses a hinge guard that was intended to keep fingers out of the door crack of vintage automobiles.

Swiss Pat. No. 133,401 discloses a metal filler device that fits inside the hinge gap of a door to strengthen the frame and create a close fit.

These patented devices, in carrying out their purposes of safety and close fit, may provide a peripheral reduction against drafts at the hinge-edge of a door. However, they are of limited efficiency, since they provide only simple blocks against air passage. A good weather seal should provide additional protection against air convection, which can lead to considerable heat loss when acting through a thin-walled seal. In addition, a seal should in a protected area, such as entirely within the hinge gap.

To achieve the foregoing and other objects and in accordance with the purpose of the present invention, as embodied and broadly described herein, the hermetic weather seal and method of application of this invention may comprise the following.

SUMMARY OF THE INVENTION

Against the described background, it is therefore a general object of the invention to provide an active, unbroken barrier inside the gap between justaposed panels, such as on the hinge side of a door.

Another object is provide an unbroken seal between adjacent panels, in which the thermal gradient is reduced within the seal itself.

A further object is to provide a hinge-edge door seal that is effective over an extended range of conditions, including times when the door is open or ajar, and with doors that may be come warped or are ill-fitting.

A more specific object is to provide a weather seal for the hinge-edge of a door, whose operation and integrity are readily apparent and confirmed at a glance.

Still another object is to provide a seal for use between closures and other panels, that is extremely simple in construction and installation, as well as inexpensive.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a hermetical seal closes in an inter-panel gap between first and second juxtaposed panel members. The seal is formed of a longitudinally elongated strip of sheet material having first and second faces and having a predetermined width defined by opposite longitudinally extending side edges. The strip has a first longitudinally elongated attachment area carrying on its first face a first adhesive band generally adjacent one of its longitudinal side edges for, in use, adhering the sheet material to a side edge of a first panel member. The strip also has a second longitudinally elongated attachment area carrying on its first face a second adhesive band generally adjacent to a second and opposite one of its longitudinal side edges for, in use, adhering the sheet material to a side edge of a second panel member spaced from the first panel member. The strip of sheet material further includes a longitudinally elongated barrier portion located between the first and second attachment areas.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

Figure 1:
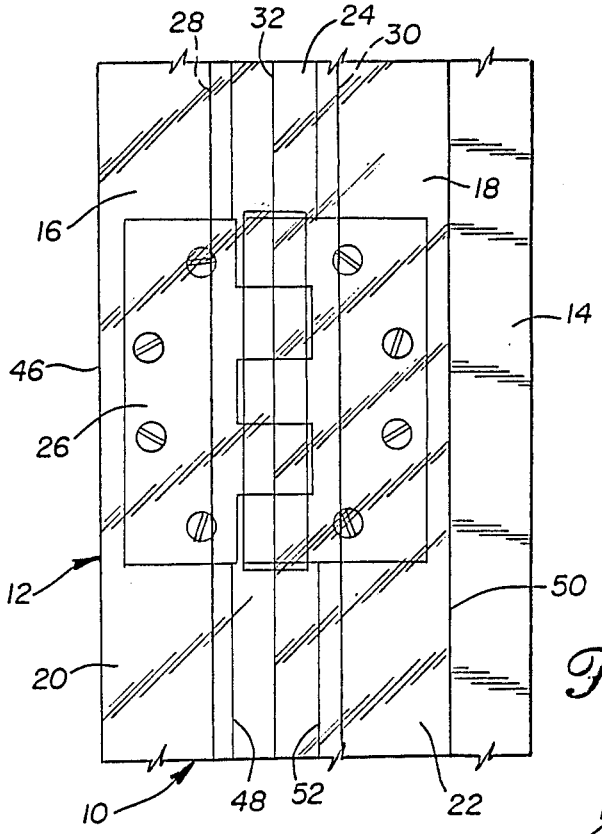
FIG. 1 is an end view of the hinge-edge of a door and jamb with the door in fully open position, showing the hermetical seal in place.

With reference to the drawings, the invention is a hermetical seal 10 that particularly is adapted for use between justaposed panels of all descriptions, although the most preferred use is between the hinge-edge of a door and its jamb. Thus, in the drawings the seal 10 is illustrated to be applied between a door 12 and its jamb 14. Such hinged panels require the seal to change its configuration as the panels are relatively pivoted. When the seal is used between non-piovted panels, it may have a single configuration or may flex to allow variability in panel spacing. In either case, the seal 10 is an active, unbroken barrier that is capable of separating two air masses with different physical characteristics. The seal is capable of preventing interaction between the air masses by the fact of its presence.

The seal is formed of flexible, resilient, air and water impervious sheet material. Thus, for purposes of description, the sheet material will be referred to in terms of its two major faces, these being the first and second, or front and back faces. By way of example and not limitation, a preferred material is clear or colored polyethylene having 0.005 inch thickness. Other plastic sheet materials having physical characteristics of flexibility, resilience, and imperviousness similar to polyethylene may be used as well. The seal also has been formed of rubber or plastic coated fabric materials. Extruded or molded plastics with integral hinges may be used.

As applied to a hinge-edge of a door, the sheet material is a longitudinally elongated strip and should have sufficient width to provide a panel attachment area 16, 18, respectively, along each of the opposite margins of the width thereof. Thus, the area 16 may overlie the narrow hinge-edge 20 of the door 12, while the area 18 overlies the hinge-mounting face 22 of the jamb 14. Between the two attachment areas, the sheet material provides a central, unbroken barrier portion or web 24 having sufficient width to allow the door to open to any desired degree and, thus, this barrier portion should not interfere with the operation of the door hinge 26. The attachment areas 16, 18 are permanently adhered on one side to, respectively, the door and the door jamb. It is preferred that the entire seal be located inside the gap between the door jamb and door when the door is in closed position.

Figure 3:
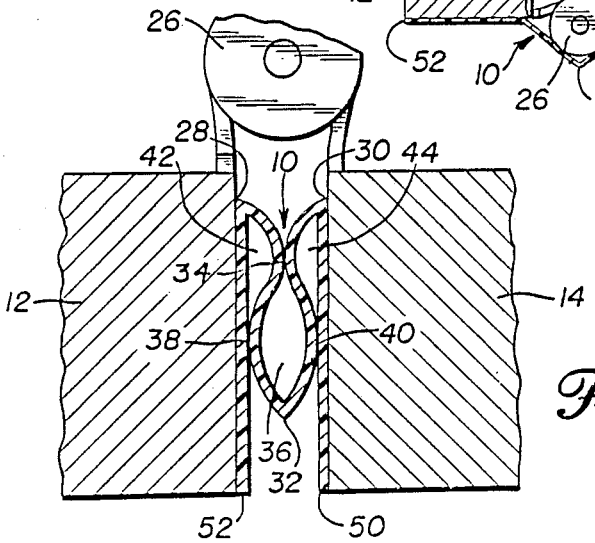
FIG. 3 is an enlarged, fragmentary view similar to FIG. 2, but showing the seal when the door in fully closed position.

In the preferred configuration of FIG. 3, the sheet material of the seal may be folded or hinged at three locations. The seal has a pair of longitudinally extending side folds or creases 28, 30, respectively, laterally offset from the longitudinal centerline of the web. These folded areas lie, respectively, at the two junctions of the attachment areas 16, 18 to the central barrier. Each of these creases is convex toward the same one of the faces of the seal, facing the door hinge. Near the center of the central barrier portion, which may be the centerline of the strip of sheet material, the seal may have a central fold or crease 32, which is convex toward the opposite face of the seal, away from the hinge.

Together, the creases 28, 30, and 32 allow the seal 10 to fold into the general shape of a "W" as the door is closed, or as applied between any other two parallel, closely gapped walls. When the door is in fully closed position, the seal defines a four layered structure in which the two attachment areas 16, 18 are approximately parallel and spaced apart by the gap of the door-edge to the jamb. The central barrier portion defines a double layered structure located between the attachment portions. The central fold 32 causes one face of the seal, which may be referred to as the front face, to be folded inside the seal. The lateral folds 28, 30 bring together the second face of the seal, exposing the first face of the attachment areas for connection to the panel member sides.

Because the preferred material is somewhat resilient and not perfectly flexible, the creases 28, 30, and 32 induce a small curvature in adjacent sections of the central barrier. With reference to the seal as shown in FIG. 3, this curvature can be seen to deform the central barrier portion 24 into two mirror image segments having a double curvature, thus defining "S" curves, one on each side of central crease 32. The "S" curves are back-to-back with their lower ends united at common crease 32 and the convex edge of the upper sweep of the "s" contacting at point 34. Thus, contact area 34 is longitudinally elongated over the length of the seal and defines a first, central air column 36. The contact area 34 is located between the central crease 32 and the laterally offset creases 28, 30. The first face of the sheet material contacts itself at area 34.

The upper ends of the "S" curves are joined to the opposite creases 28 and 30. The convex edge of the lower sweep of the "S"' meet the attachment areas 16 and 18 at respectively contact areas 38 and 40. At these areas, the second faces of the sheet material are in contact. The contact area is between the central and laterally offset creases, and, in fact, is between the central crease and the contact area 34. In this configuration, the upper portions of the curves define respective second and third air columns 42 and 44.

The three columns 36, 42, 44 of trapped air are created when the door is closed, trapping the air between the folding surfaces of the central barrier portion. The columns are maintained within the door-edge or inter-panel gap and constitute a thermal gradient reducing means. The air columns have been found to maintain their structure when the seal is used over a substantial range of gaps. A gap as wide as ⅛ inch has been found to be closed by the seal.

The seal may be produced from flat plastic sheeting and, accordingly, may be supplied in selected lengths to fit doors or other panels of any height. The plastic sheeting may be supplied in typical door heights such as eighty-four inches, or it may be supplied in rolls of any selected length, wherein the sheeting is cut to fit each application.

The width of the plastic sheeting strip is dependent upon the thickness of the door panel and geometry of the hinge, if any. Typically, the width will be approximately three times the thickness of the panel to which it is to be applied. More specifically, each attachment area 16, 18 will be equal or slightly smaller in width than the thickness of the panel. For a panel having a width of one and three-fourths inches, each attachment area is preferred to have a width of one and one-half inches. As installed on the hinge-edge of a door, the attachment area 16 will extend from the corner 46 furthest from the hinge to a line spaced one-quarter inch inward from the corner 48 closest to the hinge. Attachment area 18 will extend from the corner line 50 of the jamb to a line spaced one-quarter inch inward from the jamb edge 52 closest to the hinge.

Crease lines 28 and 30 of the seal mark the inset edges of the attachment areas. This inset helps to conceal the seal by allowing the seal to be contained entirely within the door edge gap when the door is closed. The attachment areas may be considerably narrower or wider, as the thickness of the panel edge requires or permits. In addition, the attachment areas 16, 18 may be either equal or unequal in width, to suit the application.

Figure 2:
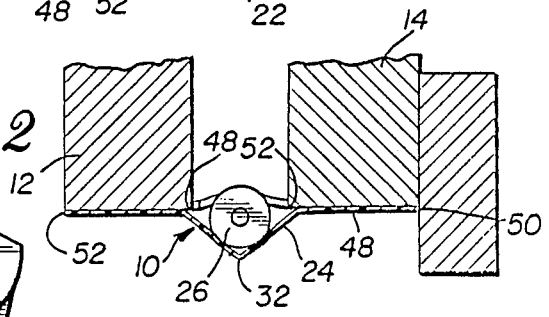
FIG. 2 is a top view of the seal, door and jamb of FIG. 1.

The barrier portion 24 of the seal has a width that is a function of the hinge geometry. A typical door hinge 26 may have a one-half inch diameter cylinder, which is installed to be offset by one-quarter inch from the door. Thus, when the door is opened fully to a parallel position with the adjacent wall, as shown in FIG. 2, the door is spaced approximately one inch from the wall, and the hinge cylinder extends approximately one-quarter inch into the doorway. A barrier portion having a width of approximately one and three-fourths inches, installed as described in the prior paragraph, allows such full opening of the door without becoming stretched.

Further, when the door is closed and the barrier becomes folded in half at crease 32, the barrier extends into the door gap by no more than one-half its width, or seven-sixteenths inch. If required by hinge geometry or other factors, the barrier could be extended in width to the combined widths of the attachment areas, or three inches in this illustration. On the other hand, barrier portions as narrow as one inch have been made, which are capable of forming the thermal gradient reducer between panels having a thickness as little as one-half inch. Still narrower barrier portions are possible.

Although it has been identified that the barrier portion forms the thermal gradient reducer by becoming folded in the door edge gap, these folds are not required to be pre-formed in the plastic sheet material. A smooth, non-prefolded sheet tends to form folds 28, 30, 32 of larger radius than would a preformed plastic sheet. Such larger radius curves are better able to form the thermal gradient reducer in relatively wide door edge gaps, such as thos of more than one-eighth inch. A pre-folded barrier portion offers the advantage of more reliably collapsing into the desired fold pattern as the door closes. In a door of typical gap, such as between one-eighth inch and one-sixteenth inch, either pre-folded or non-folded polyethylene sheets have been found to perform well.

The following examples illustrate specific methods of constructing the real, active, unbroken barrier seal.

Example 1. For a residential door one and three-fourths inches wide -- Necessary materials are clear or colored polyethylene 0.005 inches in thickness and double sided adhesive tape one and one-half inches wide. A strip of polyethylene four and three-fourths inches wide and eighty-four inches long is sufficient to make one seal.

The protective covering is removed from one side of a strip of the double sided adhesive tape. The exposed adhesive side of the tape is applied to one face of the polyethylene strip, adjacent to one of the long edges, for the full eighty-four inch length. A second strip of the tape is similarly applied along the opposite edge of the same face of the polyethylene.

The seal is applied beginning from the top inside corner formed by the door frame and molding. The polyethylene strip is centered over the hinge in a longitudinally vertical position with the taped side facing the hinge. The protective covering is removed in convenient increments from the adhesive surface over the door frame, and the seal is attached to the hinge-mounting jamb by following the corner line. Then, the protective covering is similarly removed from the adhesive surface over the door hinge-edge, and the seal is attached by following the edge line furthest from the hinges. The installation is complete at this point. The seal will fold into the desired "W" configuration as the door is closed.

Example 2. Production of random length seal -- A strip of polyethylene sheet material having a width of four and one-half inches and any desired length is provided. Adhesive material is directly deposited on the strip, along a longitudinal path approximately one and one-half inches wide, adjacent each longitudinal edge of one face of the polyethylene. The strip is rolled lengthwise in the manner of twin rolls of tape, with the intermediate section approximately one and one-half inchs wide being substantially free of adhesive.

The seal is applied by unrolling the adhesive strip in convenient increments while pressing the adhesive in place against the hinge-edge of the door and the adjacent hinge-mounting jamb. The edges of the seal are applied to follow the corner line of the jamb and the edge line of the door, as described above.

Example 3. Production of seal with pre-formed thermal gradient reducer -- A strip of flexible, resilient plastic sheeting having a width of approximately four and one-half inches is creased and folded upon itself along the longitudinal center-line to form a double layer of plastic sheeting two and one-fourth inchs wide. Then, each layer of the sheeting is creased along a line located approximately three-fourths inch from the center fold, which corresponds to a line located approximately one and one-half inchs from the free edge. On these side crease lines, the plastic sheeting is folded in the direction opposite that of the center fold. The resulting folded structure has two center layers that constitute a pre-formed thermal gradient reducer.

Adhesive is applied to the full width of the two outward facing surfaces of the folded structure. A protective, removeable cover may be placed over the adhesive to preserve it until the later installation of the seal.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. In combination with a door hingedly mounted at one edge to a jamb and having a hinge-edge gap defined between respective facing hinge edges of the door and jamb, a flexible hermetical seal located within the gap and having at least two configurations responsive to relative open and closed pivotal positions of the door within the jamb, the first a relatively unfolded position closing the gap and the second a relatively more folded position forming a plurality of air columns within the gap, reducing thermal gradient across the gap, the seal comprising:

a longitudinally elongated strip of flexible, resilient sheet material having first and second faces and having a predetermined width defined by two opposite longitudinally extending side edges;

a first portion of said strip being a first longitudinally elongated attachment area carrying on said first face of the strip a first adhesive band generally adjacent one of said longitudinal side edges of the strip and adhering the strip to said door inside said hinge gap, and a second portion of the strip being a second longitudinally elongated attachment area carrying on said first face a second adhesive band generally adjacent the second and opposite of said longitudinal side edges of the strip and adhering the strip to the jamb inside the hinge gap, and a longitudinally elongated barrier portion located between said first and second attachment areas;

wherein said attachment areas are adhered to the door and jamb with the longitudinal side edges of the strip positioned furthest from the hinge and the barrier portion centrally curved away from the hinge, such that the barrier portion is folded between the attachment areas and forms therewith a plurality of air columns when the door is closed with respect to the jamb.

2. The hermetical seal of claim 1, wherein said barrier portion comprises a first longitudinal extending fold curving in a first direction such that said first face of the strip is inside said first fold, and the strip further comprises second and third longitudinally extending folds, each curved in the second, opposite direction such that said second face of the strip is inside said second and third folds; and wherein the first fold is central of the second and third folds, such that said first and second adhesive bands are exteriorly facing.

3. The hermetical seal of claim 2, wherein said second fold is substantially at the area intermediate said first attachment area and barrier portion.

4. The hermetical seal of claim 2, wherein said third fold is substantially at the area intermediate said second attachment area and barrier portion.

5. The hermetical seal of claim 2, wherein when the door is in closed position with respect to the jamb said barrier portion contacts itself at two laterally offset, longitudinally extending contact areas on said first face and defines a first transversely closed, longitudinally extending air column.

6. The hermetical seal of claim 5, wherein said contact areas beteen parts of the barrier portion are laterally offset on opposite lateral sides of said first fold.

7. The hermetical seal of claim 5, wherein said barrier portion and first attachment area form said second air column by contacting two longitudinally extending areas of said second face, one such contact area being intermediate said first and second folds and the second such contact area being on said first attachment area.

8. A hermetical seal for closing an interpanel gap between first and second juxtaposed panel members, comprising:

a first panel;

a second panel in juxtaposed relationship to the first panel, the first and second panels each having a side wall facing toward the other and together defining an interpanel gap;

a longitudinally elongated strip of flexible, resilient sheet material having first and second faces and defining a longitudinally extending central barrier web and a pair of longitudinally extending attachment areas, one attachment area being on each lateral side of said web and each being attached to a different one of said side walls of said first and second panels, within said interpanel gap;

the strip of sheet material having a central, longitudinal fold upon itself through said barrier web, with said first face interior to the fold, and having two laterally offset longitudinal folds upon itself, one between the barrer web and each attachment area, each offset fold having said second face interior to the fold;

an adhesive coating on said first face on at least portions of said attachment areas; and wherein said panel side walls are sufficiently close that the attachment areas and the barrier web define three longitudinally extending air columns;

a central air column is defined by contact between longitudinally extending portions of said first face of the barrier web, one such portion being on each lateral side of said central fold;

a first side air column is defined by contact between longitudinally extending portions of said second face of the barrier web and the second face of a first attachment area; and a second side air column is defined by contact between longitudinally extending portions of said second face of the barrier web and the second face of a second attachment area.

9. A multi-panel assembly having a hermetical seal closing an inter-panel gap, comprising:

a pair of adjacent panels having an interpanel gap defined between the juxtaposed side walls of said panels; and a seal formed of sheet material having first and second faces, wherein said seal is attached to the side wall of one of said pair of panels at a first attachment portion next adjacent to an edge thereof; and said seal is further attached to the side wall of the other of said pair of panels at a second attachment portion spaced apart from said first attachment portion and defining therebetween a web portion;

wherein said web defines three folded areas, the first folded area extending along a line central of the first and second attachment portions and concave to said first face, the second folded area extending along a line offset from the first folded area toward the first attachment portion and convex to the first face, and the third folded area extending along a line offset from the first folded area toward the second attachment portion and concex to the first face;

wherein the web wall between the first and second folded areas contacts the second face of the first attachment portion, the web wall between the first and third folded areas contacts the second face of the second attachment portion, and the web walls on the opposite sides of the first fold contact each other, thereby forming a three chamber insulator.

10. The multi-panel assembly of claim 9, further comprising an adhesive strip on said first face of the first and second attachment portions.

11. The multi-panel assembly of claim 9, wherein one of said panels is a door and the other said panel is the jamb of said door, said justaposed side walls of the panels comprising the hinge edge of the door and the hinge edge of the jamb.

* * * * *